US008070616B2

(12) United States Patent
Dubois et al.

(10) Patent No.: US 8,070,616 B2
(45) Date of Patent: Dec. 6, 2011

(54) METHOD AND APPARATUS FOR ADJUSTING RIDER MOVEMENT ON A WATERSLIDE AMUSEMENT DEVICE

(76) Inventors: Raymond Joseph Dubois, Coquitlam (CA); Claudio Javier Barrera, Vancouver (CA); Carroll David Mosley, Austin, TX (US); Stephen Earl Horras, San Antonio, TX (US)

( * ) Notice: Subject to any disclaimer, the term of this patent is extended or adjusted under 35 U.S.C. 154(b) by 145 days.

(21) Appl. No.: 12/533,586

(22) Filed: Jul. 31, 2009

(65) Prior Publication Data

US 2011/0028227 A1 Feb. 3, 2011

(51) Int. Cl.
*A63G 21/18* (2006.01)
*A63G 21/00* (2006.01)

(52) U.S. Cl. ..... 472/117; 472/128

(58) Field of Classification Search ..... 472/13, 472/116–117, 128, 129; 104/69–70; 177/128, 177/255, DIG. 9
See application file for complete search history.

(56) References Cited

U.S. PATENT DOCUMENTS

| | | | | |
|---|---|---|---|---|
| 4,662,463 | A * | 5/1987 | Rosenthal et al. | 177/164 |
| 4,733,736 | A * | 3/1988 | Holtgreven et al. | 177/255 |
| 5,011,134 | A | 4/1991 | Langford | |
| 5,137,497 | A | 8/1992 | Dubeta | |
| 5,213,547 | A | 5/1993 | Lochtefeld | |
| 5,230,662 | A | 7/1993 | Langford | |
| 5,453,054 | A | 9/1995 | Langford | |
| 5,503,597 | A | 4/1996 | Lochtefeld | |
| 5,779,553 | A | 7/1998 | Langford | |
| 6,315,674 | B1 | 11/2001 | Slade | |
| 6,354,955 | B1 | 3/2002 | Stuart | |
| 6,485,372 | B2 | 11/2002 | Stuart | |
| 6,702,687 | B1 | 3/2004 | Henry | |
| 6,729,963 | B2 | 5/2004 | Hlynka | |
| 6,945,873 | B2 | 9/2005 | Hlynka | |
| 7,056,220 | B2 | 6/2006 | Hunter | |
| 7,179,173 | B2 | 2/2007 | Henry | |
| 7,229,359 | B2 | 6/2007 | Henry | |
| 7,371,182 | B2 | 5/2008 | Henry | |
| 7,371,183 | B2 | 5/2008 | Henry | |
| 7,491,128 | B2 | 2/2009 | Henry | |
| 7,504,594 | B1 * | 3/2009 | Ruth et al. | 177/128 |
| 2005/0282643 | A1 | 12/2005 | Hlynka | |
| 2006/0128487 | A1 * | 6/2006 | Johnson | 472/128 |
| 2007/0207866 | A1 | 9/2007 | Hunter | |
| 2007/0207869 | A1 | 9/2007 | Hunter | |
| 2007/0259726 | A1 | 11/2007 | Evans | |

FOREIGN PATENT DOCUMENTS

| | | | |
|---|---|---|---|
| CA | 2 580 220 | A1 | 9/2007 |
| WO | 95/26793 | A1 | 10/1995 |
| WO | 00/62882 | A1 | 10/2000 |

* cited by examiner

*Primary Examiner* — Kien Nguyen
(74) *Attorney, Agent, or Firm* — Snell & Wilmer L.L.P.

(57) ABSTRACT

In waterslide amusement devices one or more water jets can be directed along the waterslide surface and used to apply a force to riders using the amusement device. In the present approach the operation of such water jet assemblies is adjusted based on the weight of each rider, so that riders of different weights can negotiate the waterslide amusement device safely and with an appropriate degree of excitement. The rider weight is conveniently measured on the waterslide amusement device, for example, using a load cell assembly, and a signal is sent to a controller to adjust the output of one or more downstream water jet assemblies based on the measured rider weight.

47 Claims, 7 Drawing Sheets

METHOD AND APPARATUS FOR ADJUSTING RIDER MOVEMENT ON A WATERSLIDE AMUSEMENT DEVICE

TECHNOLOGY FIELD

The present disclosure relates to waterslide amusement devices, such as undulating waterslides wherein riders are propelled at least in part by gravity along a rollercoaster-like progression of downhill runs and at least one uphill run. In particular, the present system and method provides adjustable acceleration along the slide path based on the inertia of the rider.

BACKGROUND

Waterslide amusement devices have been popular for decades. In the simplest waterslide, a rider climbs a stairwell located in a tower. The rider then enters an entrance of the waterslide and is propelled by gravity along the waterslide until splashing into a pool located at an end of the waterslide. Water flows down the waterslide along with the rider to decrease friction and enhance the entertainment value of the ride. Thus, a rider coasts along a slippery surface from a higher elevation to a lower elevation, either in a straight line path or on a path that includes curves. One variation of this approach has been to introduce undulations into the waterslide, so that the rider is propelled by gravity along a rollercoaster-like progression of downhill and uphill runs.

The "rider" can be an individual using the waterslide amusement device, for example in a sitting or prone position, or one or more persons using the waterslide amusement device on a mat, raft, tube or other conveyance device designed to slide on the waterslide surface.

Waterslide amusement devices that rely solely or primarily on gravity to propel the rider are expensive to manufacture and construct because they typically require the construction of a large, high tower, and an intricate elevated framework for supporting the waterslide high above the ground. One solution to this problem has been to provide a lift mechanism to raise a rider to a starting height, eliminating the need for the rider to climb stairs to ascend the tower. However, such lift mechanisms generally convey the rider at a constant speed, and add no excitement to the rider's experience. Some waterslide amusement devices include one or more variable speed conveyor belts interfaced with the slide for transporting the rider along uphill sections of the slide path (for example, as described in U.S. Pat. No. 7,371,183). The conveyor system may further include a control system having a sensor for sensing the speed of the rider. The control system can be adapted to control the speed of the variable speed conveyor belt based upon the sensed speed of the rider.

Another approach has been to propel the rider up an inclined waterslide surface or accelerate the rider along downhill and uphill segments of the slide using water jets, rather than have the rider propelled by gravity alone (for example, as described in U.S. Pat. No. 5,213,547). A series of water jets may be used to direct high-pressure water along the waterslide surface, and in the process propel the rider along the slide path. Although effective, this approach has certain limitations. If the force of the jets is too low then riders may only be conveyed a short distance along the slide path. If the jets are too powerful and the rider moving too slowly, then the rider may experience a jerky ride. Furthermore, if the force of the water jets propelling the rider is not adjusted then riders of different weights may be accelerated along the waterslide for different distances at different speeds and with different consequences for the rider's experience. Lighter riders may be propelled up a hill too far or too forcefully, at unsafe or undesirably high speeds. Heavier riders may move too slowly to provide sufficient excitement, or even too slowly to reach the crest of a hill. If the rider fails to reach the crest, the rider may slide backwards into the valley between uphill and downhill segments, creating a safety hazard, and requiring intervention to complete or terminate the ride.

Some waterslide amusement devices use rider speed traps, in which the speed of the rider is measured by timing the rider's travel along a slide path between two or more photocells. In some cases, the water volume and flow rate of the water jets are adjusted based on the measured speed of the rider. One problem with this method is that the operation of the photocells can be adversely affected by spray, and can be triggered by other extraneous motion in addition to the passage of the rider. False readings from the photocells can generate errors in the control system and can constitute a safety hazard. Also, measurement of rider speed at a particular location is not necessarily a reliable determinant of the force that will need to be applied to the rider in order for the rider to safely negotiate a downstream portion or feature of the slide path with an appropriate degree of excitement.

The present approach takes into account the inertia of the rider.

SUMMARY

In one aspect, a waterslide amusement device comprises a slide surface for supporting a rider traveling along a slide path, and a water jet assembly positioned to direct water along a portion of the slide surface and apply a force to the rider. The waterslide amusement device further comprises a sensor capable of sensing a parameter indicative of the inertia of the rider, and a control system in communication with the sensor and the water jet assembly. The control system is configured to adjust the force applied to the rider by operation of the water jet assembly based upon input received from the sensor that is representative of the sensed parameter. The sensor is preferably a weight-measuring device with the sensed parameter being the weight of the rider.

In some embodiments of the above-described waterslide amusement device, the sensor, such as a weight-measuring device, is located on the slide path. For example, the sensor device can be located on the slide path upstream of the water jet assembly.

In another aspect, a waterslide amusement device comprises a slide surface for supporting a rider traveling along a slide path and a water jet assembly positioned to direct water along a portion of the slide surface and apply a force to the rider. The waterslide amusement device further comprises a control system configured to adjust the force applied to the rider by operation of the water jet assembly based upon an input parameter indicative of the inertia of the rider, such as a measurement or an estimate of rider weight.

In one aspect, a system for affecting movement of a rider traveling along a waterslide surface comprises a water jet assembly configured to direct water along a portion of the waterslide surface and apply a force to the rider. The system further comprises a sensor capable of sensing a parameter indicative of the inertia of the rider, and a controller in communication with the sensor and the water jet assembly. The controller is configured to adjust operation of the water jet assembly based upon input received from the sensor representative of the sensed parameter. The sensor is preferably a weight-measuring device with the sensed parameter being the weight of the rider.

In some embodiments of the above-described system, the sensor, such as a weight-measuring device, is incorporated into the waterslide surface upstream of the water jet assembly.

In another aspect, a system for affecting movement of a rider traveling along a waterslide surface comprises a water jet assembly positioned to direct water along a portion of the waterslide surface and apply a force to the rider. The system further comprises a controller that is configured to adjust operation of the water jet assembly based upon an input parameter indicative of the inertia of the rider, such as a measurement or an estimate of rider weight.

In the above-described waterslide amusement devices and systems, the weight measuring device can comprise at least one load cell. The water jet assembly can comprise at least one nozzle and at least one pump for pumping water through the at least one nozzle. The control system can be configured to adjust the operation of the water jet assembly and the force applied to the rider, for example, by adjusting a flow rate and/or duration of the flow of water flowing through the at least one nozzle, or by activating a predetermined number of nozzles. One or more water jet assemblies can be located and oriented for various purposes including for example, to accelerate the rider up a hill in an undulating slide path, to assist gravity in accelerating the rider down a hill in an undulating slide path, or to slow the speed of the rider along the slide path.

In one aspect, a method for affecting movement of a rider on a waterslide surface that supports a rider traveling along a slide path comprises directing a pressurized jet of water along at least a portion of the waterslide surface so that the pressurized jet of water provides a force to the rider. The method further comprises sensing a parameter indicative of the inertia of the rider, and adjusting the force applied to the rider by the pressurized jet of water based upon the sensed parameter. The sensed parameter is preferably the weight of the rider.

In some embodiments of the above-described method, the parameter can be sensed on the slide path. For example, rider weight can be sensed at a first location on the slide path with the pressurized jet of water providing force to the rider at a second location on the slide path that is downstream of the first location. The weight of the rider can be sensed using a device comprising at least one load cell. The rider can be substantially stationary or can be traveling along the slide path when the rider weight is sensed.

In another aspect, a method for affecting movement of a rider on a waterslide surface that supports a rider traveling along a slide path comprises directing a pressurized jet of water along at least a portion of the waterslide surface so that the pressurized jet of water provides a force to the rider. The method further comprises adjusting the force applied to the rider by the pressurized jet of water based on a parameter indicative of the inertia of the rider, such as a measurement or an estimate of rider weight.

In the above-described methods, the force applied to the rider by the pressurized jet of water can be adjusted, for example, by adjusting a flow rate and/or duration of the pressurized jet. The pressurized jet of water can be directed along the waterslide surface in a direction that is substantially in the direction of travel of the rider, for example, so that it accelerates a rider up a hill in the slide path. Alternatively, the pressurized jet of water can be directed along the waterslide surface in a direction that is substantially opposite to the direction of travel of the rider, for example, so that it decelerates a rider on the slide path.

In one aspect of a weight-measuring device for measuring rider weight on a waterslide amusement device comprising a slide surface for supporting a rider traveling along a slide path, the device comprises a weight-bearing platform that forms a portion of the slide path, and a cross-bracket extending between a pair of load cells. The cross-bracket and the load cells are located underneath the weight-bearing platform, whereby when a rider is positioned on the platform, a force is applied to the load cells via the cross-bracket, and the load cells transmit a signal indicative of the weight of the rider.

In one aspect of a method for measuring rider weight on a waterslide amusement device comprising a slide surface for supporting a rider traveling along a slide path, the method comprises positioning a rider on a weight-bearing platform that forms part of the slide path so that a force is applied to a pair of load cells, and transmitting a signal from the load cells indicative of the weight of the rider.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

BRIEF DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
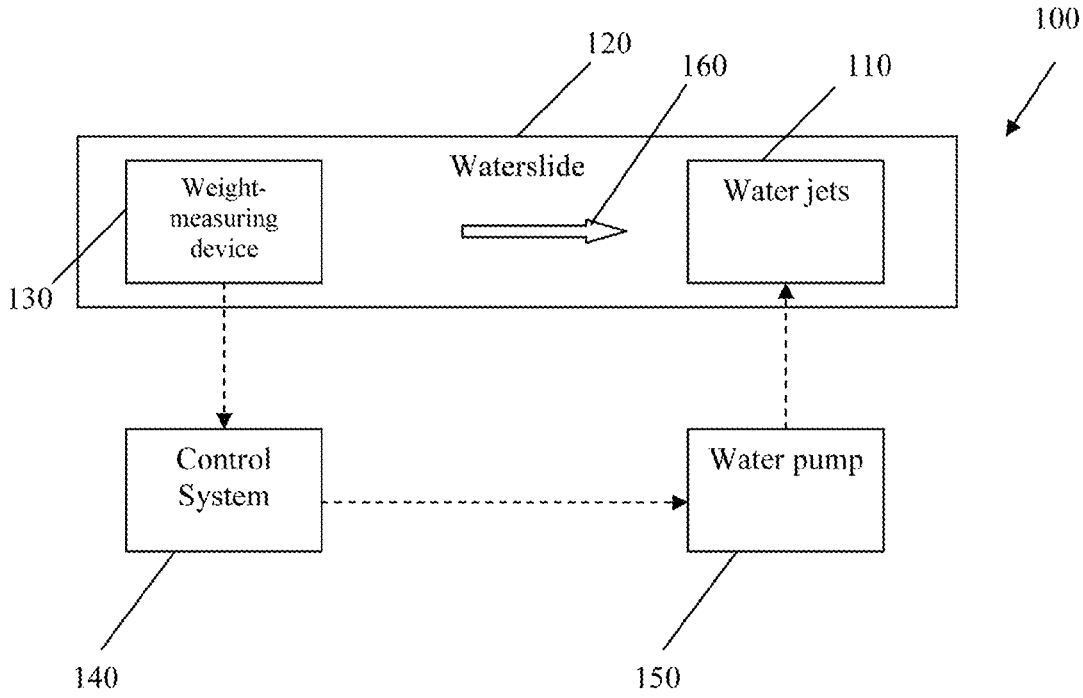
FIG. 1 is a simplified schematic diagram of an exemplary embodiment of a system for affecting the movement of a rider along a waterslide, the system comprising a water jet assembly for applying a force to the rider, a device for measuring the weight of the rider and a control system for adjusting the operation of the water jets based on the measured weight.

FIG. 1 is a simplified schematic diagram of an embodiment of a system 100 for affecting the movement of a rider along a waterslide. System 100 includes one or more water jets 110 which can, for example, be used for accelerating a rider along a portion of a waterslide 120, with the direction of rider travel indicated by arrow 160. A weight-measuring device 130 is used to measure the weight of the rider at a location upstream of water jets 110 and sends this information to a control system 140 which adjusts the water volume and flow rate provided to water jets 110. Water jets 110 can be connected to receive water from a water pump assembly 150. Water pump assembly 150 can comprise an electrically-powered pump connected to a variable frequency drive (VFD). The control system can vary the power supplied to the pump by adjusting the operating electrical frequency of the VFD, and thereby adjusting the pump output and the rate at which water flows through water jets 110. Control system 140 may also vary the duration for which water jets 110 are operated, or for which they are operated at a particular flow rate, based upon information received from weight-measuring device 130, and/or depending on other parameters such as a preset time duration or a duration triggered by a rider's arrival at a particular sensor. A programmable logic controller (PLC) in control system 140 can be used to automate control of water pump 150. Rider weight is generally a reliable determinant of the force that will need to be applied to the rider in order for the rider to safely negotiate a downstream portion or feature of the slide path with an appropriate degree of excitement, because it relates to the inertia of the rider. Prior systems that sense rider speed at a particular location tend to be less reliable.

The system described in FIG. 1 can be incorporated into a waterslide at any suitable or desired location(s) along the waterslide path or at a location at or near the entry or exit of the waterslide. For instance, at least a portion of the system may be located upstream of one or more uphill sections of the slide path. In addition, the system can be used at or near where a rider enters the waterslide and/or at one or more places along the slide path. For example, if there is more than one uphill section to the waterslide, the system described in FIG. 1 may be used at more than one place. In other embodiments, components of the system may be located along portions of the waterslide as necessary to control the operation of one or more water jets. For instance, a weight-measuring device 130 and control system 140 may be used to adjust the operation of one or more sets of downstream water jets 110, each set placed near the foot of a different uphill section. As used herein the term "downstream" means further along the waterslide in the direction of travel of the rider.

Thus, the operation of one or more sets of water jets can be adjusted based on the rider weight as described above in order to cause the rider to negotiate the slide path safely and with an appropriate degree of excitement. In some cases, rather than being used to assist in moving or accelerating a rider up a hill, water jets may be used accelerate a rider along a flat or downhill section of the slide path, or to assist with rider launch by injecting water at the entry box. In other cases water jets can be oriented to direct the water in a direction that is substantially opposite to the direction of rider travel. For example, they can be used to slow or decelerate a rider, for example at the end of a waterslide, or to hold a rider at the top of a hill and then release them (by suddenly decreasing or stopping the water flow) in a "starting gate" arrangement. Accordingly, it should be apparent to one of ordinary skill in the art that the system described above with reference to FIG. 1 as well as the system components described hereinafter with respect to various exemplary waterslide assemblies are illustrative in nature, and should not be construed as limiting the scope of the claimed subject matter.

Figure 2:
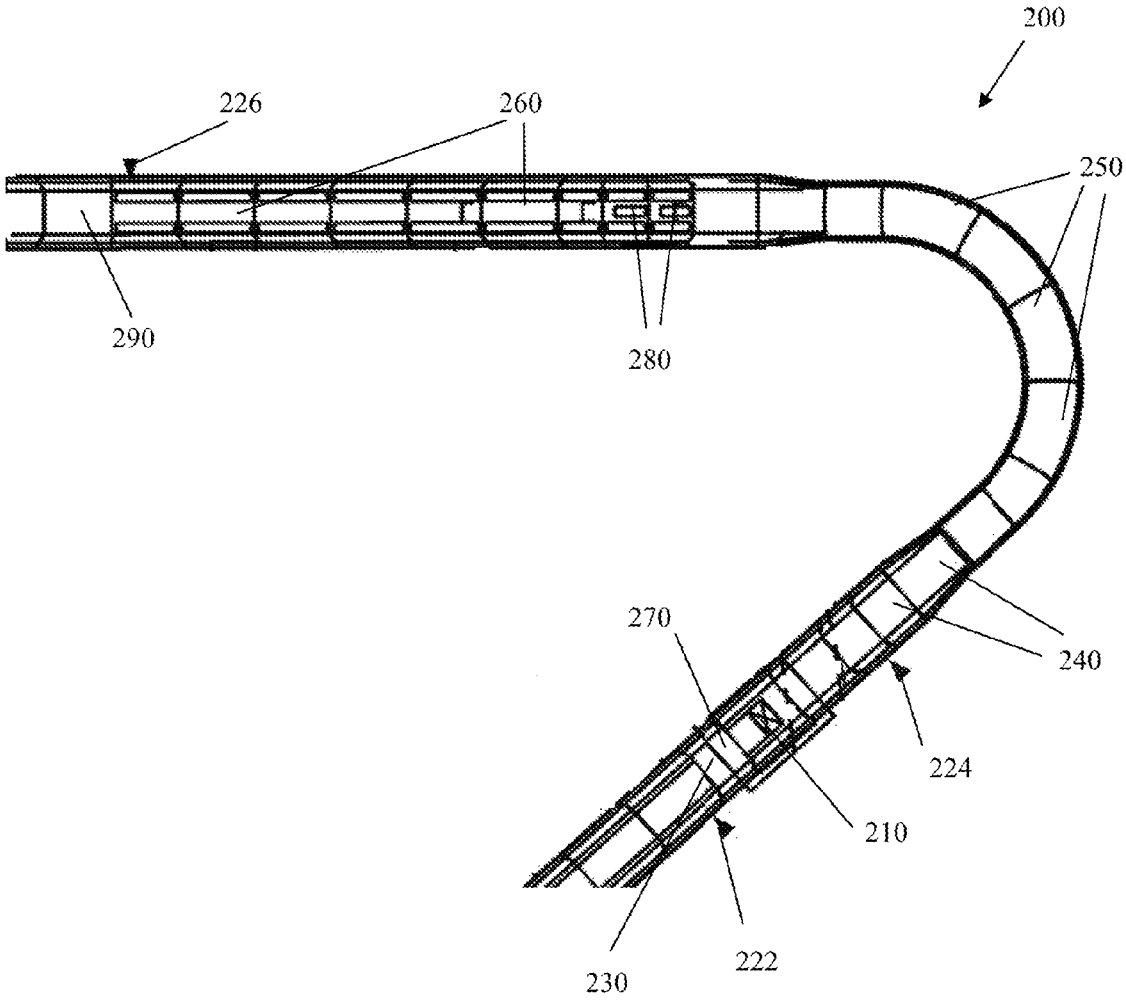
FIG. 2 is a top plan view showing a portion of an exemplary embodiment of an undulating waterslide comprising a weight-measuring device located on the slide path to measure the weight of the riders, and downstream water jets the operation of which is adjustable based on the rider weight measurement.

FIG. 2 is a top plan view showing a portion of an exemplary undulating waterslide 200 comprising a downhill section 240, a turn 250, and an uphill section 260 cresting at peak 290. A weight-measuring device 210 is located at crest 270 at or near the top of a dry conveyor 230 along which riders are brought to the start of the ride. Device 210 is used to measure the weight of the rider before the rider enters the downhill section 240. The rider can be stationary or moving when the measurement is taken. First and second sensors 222 and 224 located upstream and downstream, respectively, of the device 210 can be used to synchronize the weight measurement with the arrival of the rider at weight-measuring device 210, as will be described in further detail below. The rider is then propelled by gravity along downhill section 240. Heavier riders tend to reach higher speeds on downhill section 240 and at the turn 250 than lighter riders. Water jets 280 located at the start of uphill section 260 assist in propelling the rider along the slide path to the crest of the hill 290. The operation of water jets 280 is adjusted based on the measured weight of the rider using a control system (not shown in FIG. 2 but, for example, as described in reference to FIG. 1).

In some embodiments weight-measuring device 210 comprises one or more load cells (as described in further detail below), and the weight of the rider can be determined based on one or more measurements taken from the load cell(s). For example, a single peak load cell reading, or an average of several load cell readings taken rapidly in sequence, or an integrated load cell output taken from the time the rider reaches sensor 222 to the time the rider triggers a sensor 224, can be used by the control system to adjust the operation of water jets 280, so that the force applied to the rider is adjusted based on the load cell reading(s).

Sometimes waterslides are divided into zones, and rider passage through the different zones is controlled for safety purposes, for instance so that a rider does not enter a particular zone until the previous rider has cleared that zone. For example, in the waterslide illustrated in FIG. 2 the portion between crests 270 and 290 can represent a zone. A sensor 226 is located at crest 290 to record the exit of the rider from the zone. Once a rider exits the zone at crest 290, the next rider is permitted (by a human operator or some other control) to enter the zone at crest 270. Thus, sensors 224 and 226 can be used to control the riders entering and exiting the zone and ensure only one rider is in the zone at any given time. Furthermore, if there are multiple zones located downstream of a weight-measuring device, the operation of water jets in each zone can be adjusted independently based on the weight of the rider who is in that particular zone. For example, as the rider exits each zone, the operation of the water jets in that particular zone can then be adjusted for the next rider, based on their weight measurement. Sensors 222, 224 and 226 can be, for example, photosensors or other suitable sensors.

The waterslide portion 200 of FIG. 2 may be incorporated into a waterslide having several uphill and downhill sections in addition to those shown in the illustrated portion. For example, the net elevation gain from the crest 270 of the conveyor 230 to the crest of the last (fourth) hill on the slide is about 5.5 m. The initial drop from crest 270 to the valley prior to the first uphill section 260 is about 3.2 m, and the elevation gain from that valley to crest 290 is about 3.8 m, with straight downhill and uphill open-flume sections being connected by a closed tube turn 250 (turning approximately 320°) at the valley.

The weight-measuring device 210 may comprise a pair of load cells and a gravity roller tray (not shown in FIG. 2) that acts as the weight-bearing platform for weight-measuring device 210, as will be described in further detail below with respect to FIG. 4. The rider rolls along the gravity roller tray and then onto the fiberglass waterslide surface. The first downhill section 240 on the slide path helps accelerate the rider (for example, one person in a single tube or two people in a double tube) from a relatively slow entry velocity at the crest 270 of the conveyor 230.

Water jets 280 comprise three propulsion nozzles (not shown) that are directed along uphill section 260 and are supplied with water from two pumps (not shown in FIG. 2) with outputs into two common manifolds. One manifold may be located in a pump room immediately downstream of the pump exits, while the second manifold may be located under uphill section 260 supplying water to all three nozzles. Valves allow metering of total pump flow, before and after the pump room manifold, may be located at the input pipes to each nozzle under uphill section 260. The pumps are of a suitable capacity, such as 56 kW, so that at or close to their maximum output they would successfully accelerate a rider of the maximum expected load, or specified load limit, to reach crest 290. The resultant thrust from the three nozzles operating at maximum capacity would propel lightweight riders over the crest of the hill at undesirably high speeds, and could be enough to lift the rider from the ride surface. Thus, for lightweight riders, the flow rate through the three nozzles is considerably reduced by a controller (PLC), based on the reading from the weight-measuring device 210. In this particular implementation, the slide has a maximum specified load limit of 181 kg (400 lbs) and a minimum rider load requirement of 22 kg (49 lbs) corresponding to a minimum rider height of about 1.2 m (4 ft).

The range of rider weights can be divided into two or more contiguous sub-ranges covering the entire range from the lower specified limit to the maximum specified limit. Each sub-range of measured weight values represents a discrete weight range. The desired output of the water pump can be determined for each discrete weight range. The control system can determine to which weight range a weight measurement belongs, and adjust the pump operating parameters accordingly. In the particular waterslide implementation described above, four operational weight ranges are used to bracket rider weights, and corresponding frequency settings are assigned for the two pump drives to give an appropriate pump output for each weight range. These levels are designated light, medium, medium-heavy and heavy. In some cases the pump output may be continuously variable, and may be adjusted in a continuous manner in accordance with rider weight, rather than in a step-wise fashion based on discrete ranges.

Various types of scales or other weight-measuring devices can be used to measure rider weight for use in adjusting the force applied to the rider by downstream water jets. Preferably the weight-measuring device is incorporated into the waterslide path so that the rider weight is measured in situ at the start of the slide or at some point along the waterslide.

A load cell assembly, comprising one or more loads cells, has been found to be a particularly suitable device for measuring rider weight in situ on a waterslide. A load cell is an electronic device (transducer) that is used to convert a force into an electrical signal. A strain gauge or another type of load cell, such as a hydraulic load cell, can be used. On-slide weight measurements obtained using a load cell assembly can be used to adjust the operation of a downstream water jet assembly and/or for other purposes. For example, such measurements could be used in a dynamic system to adjust some other operating parameter of the waterslide or as part of a safety system to check rider weights and enforce weight limits.

Figure 3:
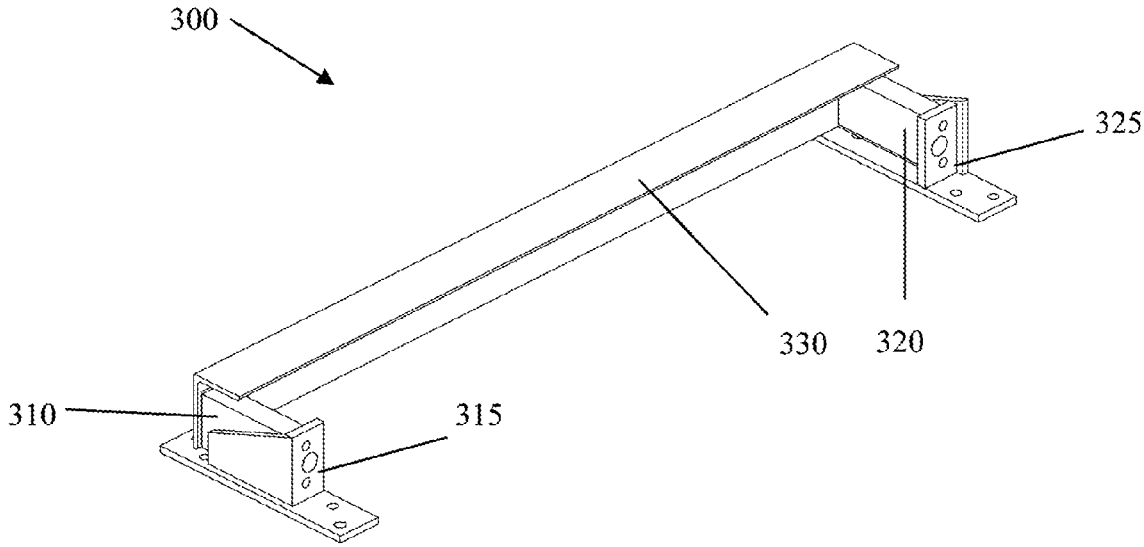
FIG. 3 is an isometric view of an exemplary embodiment of a load cell assembly that can be used in a waterslide for measuring the weight of a rider.

FIG. 3 is an isometric view of an embodiment of a load cell assembly 300 that can be used in a waterslide for measuring the weight of a rider. Two industrial grade load cells 310 and 320 are used to determine the weights of riders using the waterslide. The required capacity of the load cells can be calculated using the maximum specified load limit for the waterslide and a number of load cell dead load calculation assumptions (for example the distribution of load between the load cell devices, the roller tray weight and the pin connection at the roller-to-conveyor interface and the roller connection at the load cell devices). For example, in the particular waterslide implementation described above, where the maximum specified rider limit is 181 kg (400 lbs), the estimated the maximum load per load cell is 164 kg (362 lb). In this implementation, two stainless steel load cells each with a capacity of 500 lb are used. Although any suitable load cell may be used, the load cells may be obtained from Phenix Mining Equipment who supplies a range of load cell products including load cells with capacities between 25 lb and 500 lb. Load cells 310 and 320 are mounted on two brackets 315 and 325, respectively, and connected by a length of steel angle 330. Such a load cell assembly 300 can be installed on a waterslide as will be described in reference to FIG. 4.

Figure 4:
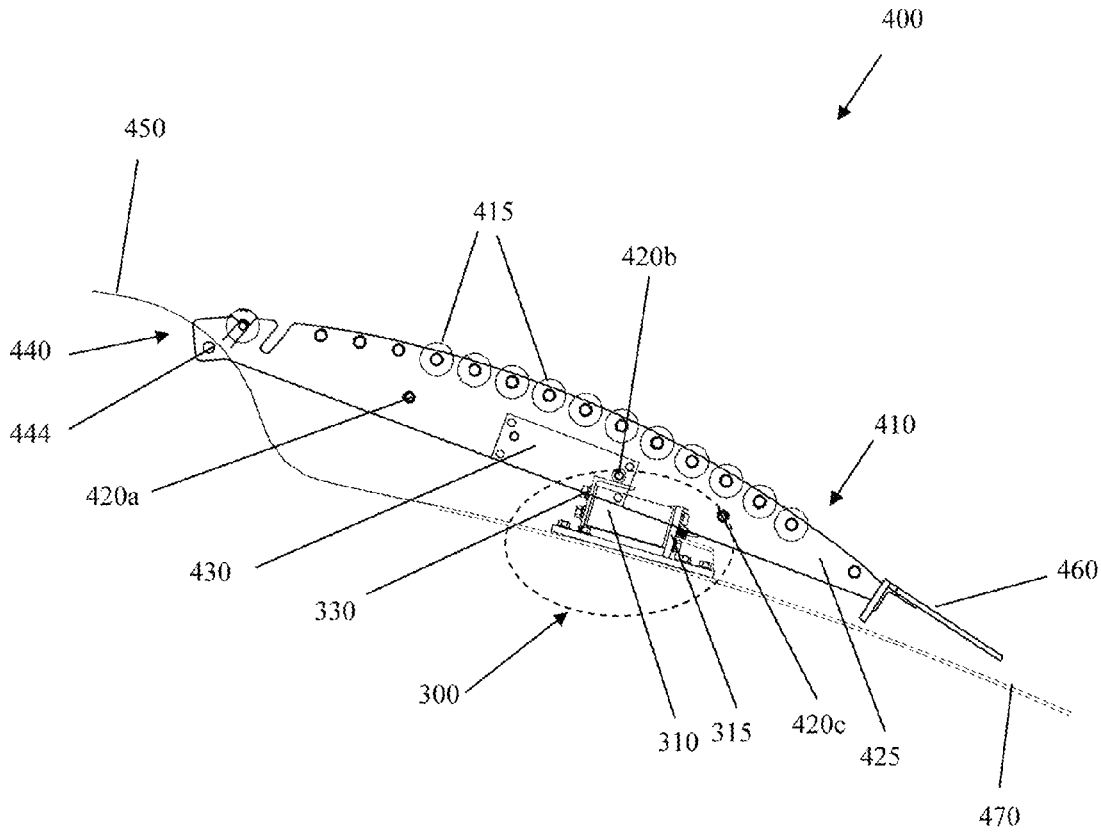
FIG. 4 is a side elevation view of a portion of a waterslide path incorporating the load cell assembly of FIG. 3.

FIG. 4 is a side elevation view of a portion of a waterslide path 400, with the load cell assembly 300 of FIG. 3 installed underneath a roller tray 410 that is used as the weight-bearing platform for the load cell assembly 300. Roller tray 410 comprises a plurality of closely spaced cylindrical rollers 415 and three cross-bracing axles 420*a*, 420*b* and 420*c* extending between a pair of side panels 425 (only one of which is visible in FIG. 4). A stiffener plate 430 attached to each side panel 425 of roller tray 410 reinforces the side panels 425 and diminishes flex that may contribute to errors in the readings from load cell assembly 300. Roller tray 410 is held in place at one end 440 by two bolts 444 (only one shown) or other suitable fasteners attached to the top of a conveyor assembly 450 or another component of the waterslide. In the illustrated embodiment, roller tray 410 pivots on the two attachment bolts 444 at uphill end 440, and cross-bracing axle 420*b* (for example, a 1" diameter stainless steel rod) rests gently on the load cell assembly, specifically on steel angle 330. When a rider moves onto roller tray 410, the tray pivots about bolts 444 downwardly and force is applied to load cell 310 (mounted on bracket 315) and load cell 320 (not visible in FIG. 4) via axle 420*b* pressing down on steel angle 330. The steel angle 330 "actuates" the load cells 310 and 320, which convert the force exerted by the roller tray 410 onto the steel angle 330 into an electrical signal indicative of rider weight. The lower end of roller tray 410 also moves downwards under the weight of a rider; it comprises a cross-piece 460 that smoothes the transition for the rider from the roller tray 410 onto the waterslide surface 470.

Figure 5:
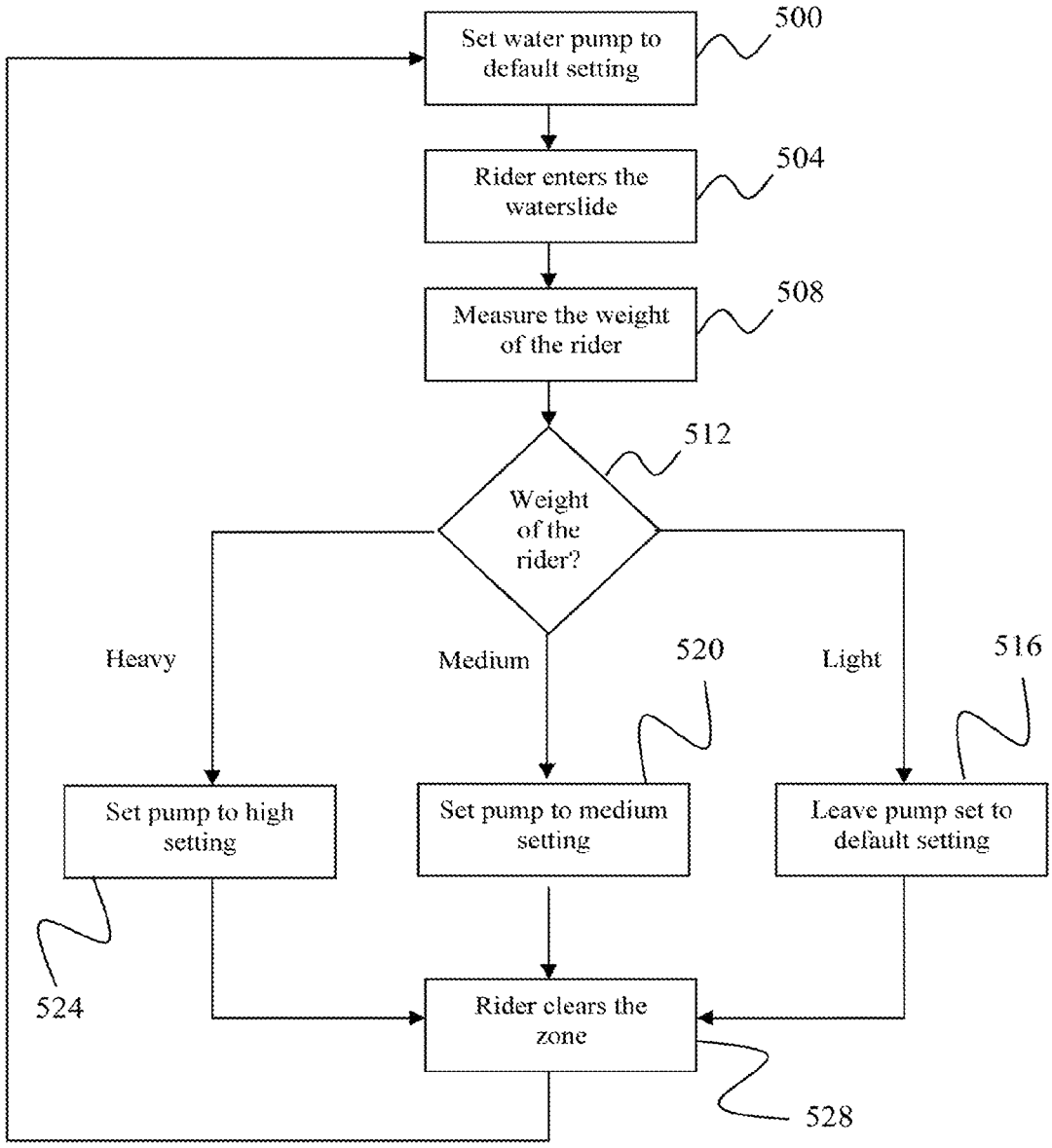
FIG. 5 is a flow chart of an exemplary embodiment of a method for adjusting the water volume and flow rate from a water pump supplying water to water jets to propel a rider along a slide path in a waterslide.

In embodiments of the present method, a controller such as a PLC can be used to control the operation of one or more waters jets used to affect the movement of riders along the waterslide based on one or more parameters, including a parameter indicative of the inertia of the rider, such as rider weight. FIG. 5 is a flow chart showing an example of such a method that can be implemented by a control system for adjusting the water volume and flow rate from a water pump used to supply water to water jets in a waterslide. Initially, as indicated by block 500, the water pump is set to default settings corresponding to the lower specified rider limit. When a rider enters the slide, as indicated by block 504, the weight of the rider is measured using a weight-measuring device, as indicated by block 508. In the illustrated embodiment, and as indicated by block 512, the measured weight is assigned to one of three ranges—heavy, medium and light. If the rider is light weight, then the water pump settings remain set at the default values, as indicated by block 516. If the rider is medium weight, then the water pump settings are adjusted to a medium output, as indicated by block 520. If the rider is heavy weight, then the water pump settings are adjusted to a high output, as indicated by block 524. The output levels depend on the exact configuration of the waterslide and are typically determined during testing and commissioning of the waterslide. When the rider has cleared a particular zone (for example, as determined by a sensor or after a certain predetermined time period has elapsed), as indicated by block 528, the pump output for that zone is returned to the default settings, as indicated by block 500, and the next rider can be weighed and can begin using the slide.

Figure 6:
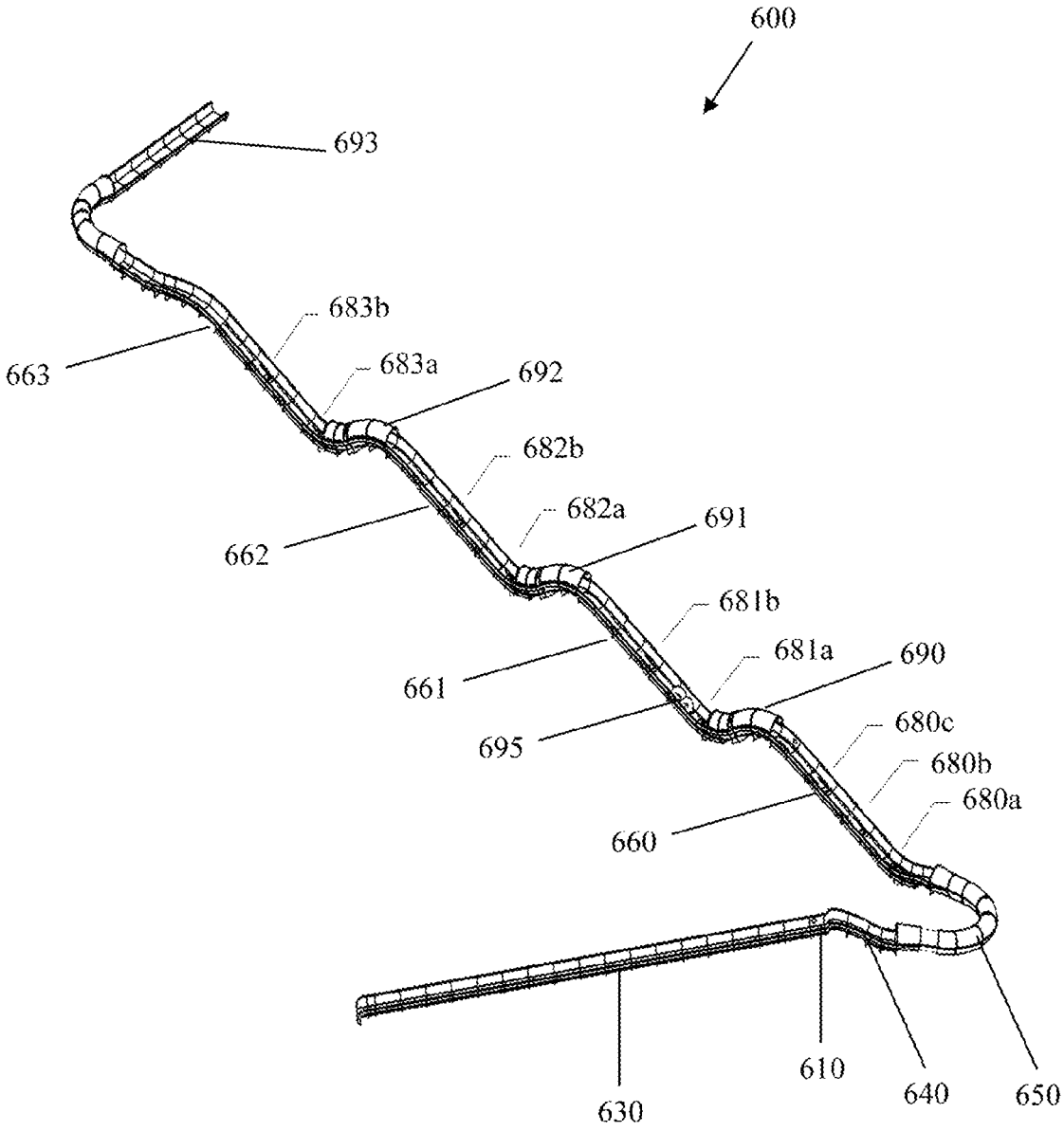
FIG. 6 is an isometric view of an exemplary embodiment of an undulating waterslide in which the slide entrance is at a lower elevation than the exit. The waterslide comprises a weight-measuring device located on the slide path near the entrance to measure the weight of the riders, and a series of downstream water jets to assist in propelling the riders up the uphill sections of the slide.

Referring to FIG. 6, an exemplary embodiment of a system for affecting the movement of a rider along a waterslide will be described with reference to an undulating waterslide 600 (a portion of a similar waterslide is shown in plan view in FIG. 2). A weight-measuring device 610 is located at or near the top of a dry conveyor 630 along which riders are brought to the start of the waterslide. Device 610 is used to measure the weight of the rider before the rider is propelled by gravity along first downhill open-flume section 640 and around closed-tube turn 650. A series of water jets (not visible in FIG. 6), positioned at locations 680*a*, 680*b* and 680*c* on first uphill section 660, assist in propelling the rider along the slide path to the crest of the first hill 690. The operation of the water jets at locations 680*a*, 680*b* and 680*c* is adjusted based on the weight of the rider, measured at device 610, using a control system (for example, as described in reference to FIG. 1). Another series of water jets (not visible in FIG. 6), positioned at locations 681*a* and 681*b* on second uphill section 661, assist in propelling the rider along the slide path to the crest of the second hill 691. Similarly water jets at locations 682*a* and 682*b* (not visible in FIG. 6) on third uphill section 662, and at locations 683*a* and 683*b* (not visible in FIG. 6) on fourth uphill section 663, assist in propelling the rider along the slide path to the crest of the third hill 692 and then to the top (exit) of the waterslide 693, respectively. The operation of the water jets at locations 681*a*, 681*b*, 682*a*, 682*b*, 683*a* and 683*b* can be adjusted based on the weight of the rider measured at device 610, using a control system, or can they can be operated at a fixed flow rate. A two-person raft 695 is shown on the second uphill section 661 of the waterslide path. Typically a framework (not shown in FIG. 6) would be used to support the waterslide 600 above the ground, or the waterslide could be mounted to close to the ground, for example, to move riders up a hill.

Figure 7:
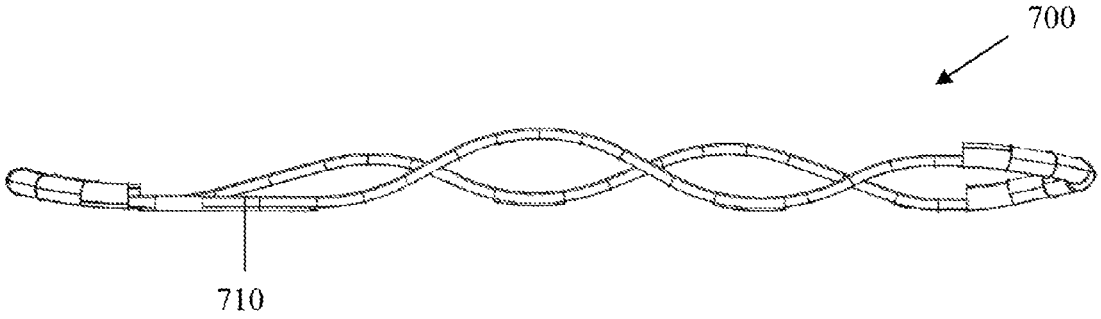
FIG. 7 is a simplified side view of an undulating waterslide with a continuous loop configuration.

FIG. 7 is a simplified side view of another exemplary undulating waterslide 700 with a continuous loop configuration. Typically a framework (not shown in FIG. 7) is used to support portions of the waterslide above the ground. The continuous loop configuration allows riders to complete multiple laps without having to exit the waterslide. In some continuous loop waterslides there can be more than one entry point onto and exit point off the waterslide. In the illustrated waterslide 700, riders enter and exit the rider at the horizontal portion 710. A load cell assembly (not shown in FIG. 7) can be installed on the waterslide, for example, in horizontal portion 710, to measure the weight of each rider. The weight measurement can then be used by a control system to adjust the operation of one or more downstream water jet assemblies (not shown in FIG. 7) used to affect the movement of riders along the waterslide surface.

In embodiments of the present system and method, the operation of the water jet assembly can be adjusted in various ways in order adjust the force provided to the rider based on rider weight. For example, the water flow rate can be adjusted as described above with reference to FIG. 5. Similarly, the duration for which a water pump is operated at a particular flow rate, the integrated volume of water delivered over a particular time period and/or the flow rate versus time profile can also be adjusted. Another option is to adjust the force applied to riders of different weights by turning some of the water jet nozzles on or off.

As described above, embodiments of the present system and method can be used to adjust the movement of riders using waterslide amusement devices that comprise open-flume and/or closed-tube slide sections that define a relatively narrow slide path along which the rider is directed. Embodiments of the present system and method can also be used to adjust the movement of riders on other types of waterslide amusement devices such as waterslide bowls, funnels, and large, wide sweeping slide surfaces across which riders move in an oscillating slide path or another often variable slide path. Examples of such waterslide amusement devices are described in U.S. Pat. Nos. 5,137,497; 6,354, 955; 6,729,963; 7,056,220, the disclosures of which are all hereby expressly incorporated herein by reference. Rides on such waterslide amusement devices are marketed under names such as Super-Bowl™, SpaceBowl™, Sidewinder™, Boomerango™, and Tornado™. Such waterslide amusement devices can comprise one or more water jet assemblies for directing water along a portion of the waterslide surface and applying a force to a rider.

In preferred embodiments of the present system and method, a weight-measuring device is incorporated into the waterslide path, so that the rider weight is measured in situ at the entrance or at some point on the waterslide amusement device, and the controller adjusts the operation of one or more downstream sets of water jets. However, in some embodiments, the weight-measuring device can be located separately from the slide path, so that the rider weight is determined before the rider is on the waterslide amusement device, and then sent to the controller. The latter approach may be simpler to implement, although it may be less convenient to the user and more subject to error in practice. Also, if a conveyance device such as a raft is to be used, it may be more convenient if the weight of the person(s) is measured without the raft, and is then adjusted by the controller to take account of the additional weight of the raft. In a further variation, rider weight could be determined or estimated in some other way besides taking a weight measurement. For example, an operator or user could estimate the rider weight as being in a particular range or category (for example, light, medium or heavy) and send a signal to the control system accordingly.

In some embodiments of the present system and method, a control system may adjust the operation of a water jet assembly based on other parameters in addition to rider weight. Thus, a combination of parameters can be used, some or all of which may be determined during the time the rider is on the waterslide amusement device. For example, the control system may use sensed rider velocities (determined using photo cells radar guns, speed trap assemblies or other suitable sensors) in combination with rider weight measurements.

While particular embodiments of the present disclosure have been shown and described, it will be understood, of course, that the claimed subject matter is not limited thereto since modifications can be made by those skilled in the art without departing from the scope of the present disclosure, particularly in light of the foregoing teachings.

What is claimed is:

1. A waterslide amusement device comprising: (a) a slide surface for supporting a rider traveling along a slide path; (b) a water jet assembly positioned to direct water along a portion of said slide surface and apply a force to said rider; (c) a sensor capable of sensing a parameter indicative of the inertia of said rider; and (d) a control system in communication with said sensor and said water jet assembly, said control system configured to adjust said force applied to said rider by operation of said water jet assembly based upon input received from said sensor representative of said sensed parameter.

2. The waterslide amusement device of claim 1 wherein said sensor is a weight-measuring device and said sensed parameter is the weight of said rider.

3. The waterslide amusement device of claim 2 wherein said weight-measuring device is located on said slide path upstream of said water jet assembly.

4. The waterslide amusement device of claim 3 wherein said slide surface and said slide path are undulating.

5. The waterslide amusement device of claim 4 wherein said water jet assembly is located and oriented to accelerate said rider up a hill in said undulating slide path.

6. The waterslide amusement device of claim 4 wherein said water jet assembly is located and oriented to assist gravity in accelerating said rider down a hill in said undulating slide path.

7. The waterslide amusement device of claim 3 wherein said weight-measuring device comprises at least one load cell.

8. The waterslide amusement device of claim 3 wherein said weight-measuring device comprises a pair of load cells.

9. The waterslide amusement device of claim 3 wherein said weight-measuring device comprises a pair of load cells actuatable by a portion of a roller tray.

10. The waterslide amusement device of claim 3 wherein said water jet assembly comprises at least one nozzle and at least one pump for pumping water through said at least one nozzle.

11. The waterslide amusement device of claim 10 wherein said control system is configured to adjust said force applied to said rider by adjusting a flow rate of water flowing through said at least one nozzle based upon said sensed rider weight.

12. The waterslide amusement device of claim 10 wherein said water jet assembly further comprises a variable frequency drive connected to drive said pump, and wherein said control system is configured to adjust said force applied to said rider by adjusting the frequency of said at least one variable frequency drive, thereby adjusting a flow rate of water flowing through said at least one nozzle based upon said sensed rider weight.

13. The waterslide amusement device of claim 10 wherein said control system is configured to adjust said force applied to said rider by adjusting the duration of flow of water through said at least one nozzle at a particular flow rate based upon said sensed rider weight.

14. The waterslide amusement device of claim 10 wherein said water jet assembly comprises a plurality of nozzles and said control system is configured to adjust said force applied to said rider by activating a predetermined number of nozzles based upon said sensed rider weight.

15. The waterslide amusement device of claim 3 wherein said water jet assembly is located and oriented to slow the speed of said rider along said slide path.

16. The waterslide amusement device of claim 3 wherein said waterslide amusement device comprises more than one water jet assembly located downstream of said weight-measuring device, each water jet assembly configured to direct water along a different portion of said slide surface, and wherein said control system is configured to adjust operation of more than one of said downstream water jet assemblies based upon said sensed rider weight.

17. A waterslide amusement device comprising: (a) an undulating slide surface including a hill for supporting and directing a rider along a slide path; (b) a water jet assembly positioned to direct water along a portion of said slide surface and apply a force to said rider to move said rider up the hill in the undulating slide surface; (c) a load cell assembly configured to sense the weight of said rider at a location on said slide path upstream of said water jet assembly; and (d) a control system in communication with said load cell assembly and said water jet assembly, said control system configured to adjust said force applied to said rider by operation of said water jet assembly based upon input received from said load cell assembly representative of said rider weight.

18. A system for affecting movement of a rider traveling along a waterslide surface, wherein said system comprises: (a) a water jet assembly configured to direct water along a portion of said waterslide surface and apply a force to said rider, wherein said water jet assembly comprises at least one nozzle and at least one pump in communication with said at least one nozzle for pumping water through said at least one nozzle; (b) a sensor capable of sensing a parameter indicative of the inertia of said rider; and (c) a controller in communication with said sensor and said water jet assembly, said controller configured to adjust operation of said water jet assembly based upon input received from said sensor representative of said sensed parameter.

19. The system of claim 18 wherein said sensor is a weight-measuring device and said sensed parameter is the weight of said rider.

20. The system of claim 19 wherein said weight-measuring device is incorporated into said waterslide surface upstream of said water jet assembly.

21. The system of claim 20 wherein said weight-measuring device is a load cell assembly.

22. The system of claim 19 wherein said control system is configured to adjust said force applied to said rider by adjusting a flow rate of water flowing through said at least one nozzle based upon said sensed rider weight.

23. The system of claim 19 wherein said control system is configured to adjust said force applied to said rider by adjusting the duration of flow of water through said at least one nozzle at a particular flow rate based upon said sensed rider weight.

24. The system of claim 19 wherein said water jet assembly comprises a plurality of nozzles and said control system is configured to adjust said force applied to said rider by activating a predetermined number of nozzles based upon said sensed rider weight.

25. The system of claim 19 wherein said system comprises more than one water jet assembly located downstream of said weight-measuring device, each water jet assembly configured to direct water along a different portion of said slide surface, and wherein said control system is configured to adjust operation of more than one of said downstream water jet assemblies based upon said sensed rider weight.

26. A method for affecting movement of a rider on a waterslide surface that supports a rider traveling along a slide path, said method comprising: (a) directing a pressurized jet of water along at least a portion of said waterslide surface so that said pressurized jet of water provides a force to said rider; (b) sensing a parameter indicative of the inertia of said rider; and (c) adjusting said force applied to said rider by said pressurized jet of water based upon said sensed parameter.

27. The method of claim 26 wherein said sensed parameter is the weight of said rider.

28. The method of claim 27 wherein said rider weight is sensed at a first location on said slide path and said pressurized jet of water provides said force to said rider at a second location on said slide path that is downstream of said first location.

29. The method of claim 27 wherein said weight of said rider is sensed using a device comprising at least one load cell.

30. The method of claim 27 wherein said force applied to said rider by said pressurized jet of water is adjusted by adjusting a flow rate of said pressurized jet of water.

31. The method of claim 27 wherein said force applied to said rider by said pressurized jet of water is adjusted by adjusting the duration of flow of said pressurized jet of water at a particular flow rate.

32. The method of claim 27 wherein said rider is substantially stationary when said rider weight is sensed.

33. The method of claim 27 wherein said rider is traveling along said slide path when said rider weight is sensed.

34. The method of claim 26 wherein said pressurized jet of water is directed along said waterslide surface in a direction that is substantially in the direction of travel of said rider.

35. The method of claim 34 wherein said pressurized jet of water accelerates a rider up a hill in said slide path.

36. The method of claim 26 wherein said pressurized jet of water is directed along said waterslide surface in a direction that is substantially opposite to the direction of travel of said rider.

37. The method of claim 36 wherein said pressurized jet of water decelerates a rider on said slide path.

38. A method for affecting movement of a rider traveling along an undulating waterslide surface that supports and directs a rider along a slide path, said method comprising: (a) directing a pressurized jet of water along at least a portion of said slide surface so that said pressurized jet of water provides a force to said rider; (b) sensing the weight of said rider on said slide path at a location upstream of said pressurized jet of water using a load cell assembly; and (c) adjusting said force applied to said rider by said pressurized jet of water based upon said sensed weight.

39. A method for operating a waterslide comprising a slide surface for supporting and directing a rider along a slide path, said method comprising: (a) directing a pressurized jet of water along at least a portion of said slide surface so that said pressurized jet of water provides a force to riders on said waterslide; (b) sensing a parameter indicative of the inertia of each rider; and (c) adjusting said force applied to each rider by said pressurized jet of water based upon said sensed parameter.

40. A waterslide amusement device comprising: (a) a slide surface for supporting a rider traveling along a slide path; (b) a water jet assembly positioned to direct water along a portion of said slide surface and apply a force to said rider; and (c) a control system configured to adjust said force applied to said rider by operation of said water jet assembly based upon an input parameter indicative of the inertia of said rider.

41. The waterslide of claim 40 wherein said parameter is an estimate of the weight of said rider.

42. A system for affecting movement of a rider traveling along a waterslide surface wherein said system comprises: (a) a water jet assembly positioned to direct water along a portion of said waterslide surface and apply a force to said rider; and (b) a controller that is configured to adjust operation of said water jet assembly based upon an input parameter indicative of the inertia of said rider.

43. The system of claim 42 wherein said parameter an estimate of the weight of said rider.

44. A method for affecting movement of a rider on a waterslide surface that supports a rider traveling along a slide path, said method comprising: (a) directing a pressurized jet of water along at least a portion of said slide surface so that said pressurized jet of water provides a force to said rider; and (b) adjusting said force applied to said rider by said pressurized jet of water based on a parameter indicative of the inertia of said rider.

45. The method of claim 44 wherein said parameter is an estimate of the weight of said rider.

46. A weight-measuring device for measuring rider weight on a waterslide amusement device comprising a slide surface for supporting a rider traveling along a slide path, said device comprising: (a) a weight-bearing platform that forms a portion of said slide path, wherein said weight-bearing platform is a pivoting roller tray; (b) a cross-bracket extending between a pair of load cells, said cross-bracket and said load cells located underneath said weight-bearing platform, whereby when a rider is positioned on said platform, a force is applied to said load cells via said cross-bracket, and said load cells transmit a signal indicative of the weight of said rider.

47. A method for measuring rider weight on a waterslide amusement device comprising a slide surface for supporting a rider traveling along a slide path, said method comprising positioning a rider on a weight-bearing platform that forms part of said slide path so that a force is applied to a pair of load cells, wherein said weight-bearing platform comprises a pivoting roller tray, and transmitting a signal from said load cells indicative of the weight of said rider.

* * * * *